US006357452B2

(12) United States Patent
Bolito

(10) Patent No.: US 6,357,452 B2
(45) Date of Patent: Mar. 19, 2002

(54) HAIR CLIP WITH MASKED SPRING

(75) Inventor: Marius Bolito, Oyonnax (FR)

(73) Assignee: Etablissements Delsol, Paris (FR)

( * ) Notice: Subject to any disclaimer, the term of this patent is extended or adjusted under 35 U.S.C. 154(b) by 0 days.

(21) Appl. No.: 09/748,379

(22) Filed: Dec. 27, 2000

(30) Foreign Application Priority Data

Dec. 28, 1999 (FR) ..... 99 16578

(51) Int. Cl.[7] ..... A45D 8/20
(52) U.S. Cl. ..... 132/277; 24/510
(58) Field of Search ..... 132/273, 275, 132/276, 277; 24/509, 510, 511

(56) References Cited

U.S. PATENT DOCUMENTS 5,642,740 A * 7/1997 Chen ..... 132/277
5,735,296 A * 4/1998 Chen ..... 132/277
5,787,905 A 8/1998 Yasuda
5,862,815 A 1/1999 Murphy
5,873,377 A * 2/1999 Yang ..... 132/277
5,881,741 A * 3/1999 Chen ..... 132/277

* cited by examiner

*Primary Examiner*—Todd E. Manahan
*Assistant Examiner*—David Comstock
(74) *Attorney, Agent, or Firm*—Young & Thompson

(57) ABSTRACT

A hair clip 100 comprising two jaws 110, 120 articulated with respect to each other about a spindle 150 and returned to the closed position by a helical spring 140 fitted around the spindle, and a piece for masking the spring, disposed between the two grasping parts 111, 121 in such a way as to cover the part of the spring fitted around the spindle.

According to the invention, the masking piece comprises two parts 130 juxtaposed along the direction of the spindle, each of the parts of the masking piece being integral with the grasping part of one jaw and each end stub 141 of the spring bearing against the corresponding part of the masking piece such that the place of motion of the end stubs of the spring is situated under the masking piece.

17 Claims, 2 Drawing Sheets

HAIR CLIP WITH MASKED SPRING

BODY OF THE INVENTION

The present invention relates to a hair clip.

It relates more particularly to a clip comprising, on the one hand, two jaws each of them having a grasping part and articulated with respect to the other about a spindle between a closed position and an open position of the clip, and returned to the closed position by a helical spring fitted around the said spindle and, on the other hand, a piece for masking the said spring, disposed between the two grasping parts in such a way as to cover the part of the said spring fitted around the said spindle.

It should be noted that without a masking piece, when the hair clip is in position, the grasping parts are separated from one another in such a way that the articulation mechanism of the said jaws, that is to say the spindle and particularly the return spring fitted around the said spindle, is visible, which is unattractive.

DESCRIPTION OF THE RELATED ART

From the document EP 0 901 759, there is already known a hair clip such as mentioned above wherein the two end stubs of the spring are mounted in an entirely conventional manner, each bearing against the inside face of the grasping part of a jaw. The masking piece of such a clip, whether it consists of one or two parts, therefore comprises notches in its lateral edges allowing the passage of the said end stubs of the return spring such that the latter remain visible.

Even though the said end stubs of the return spring are of small size, the fact that they remain visible beyond the masking piece makes the aesthetics of such a clip imperfect.

SUMMARY OF THE INVENTION

In comparison with the said prior art, the present invention therefore proposes a new hair clip wherein the design of the masking piece is relatively simple, of small size, and makes it possible to render the return spring totally invisible such that the external appearance of this clip is improved.

More particularly, according to an essential characteristic of the hair clip according to the invention, the said masking piece comprises two parts juxtaposed along the direction of the said spindle, each of the said parts of the masking piece being integral with the grasping part of one jaw and exhibiting an inside surface, facing the helical spring, each end stub of the said spring bears against the corresponding part of the said masking piece such that the place of motion of the said end stubs of the said spring, during the opening and closing of the said clip, is situated under the said masking piece.

Thus, according the invention, the assembly of the return spring on the said clip is reversed in comparison with the conventional assembly, and the said spring, including its end stubs, is totally concealed under the masking piece such that it is invisible from the outside.

Other non-limitative and advantageous characteristics of the hair clip according to the invention are as follows:

- each part of the masking piece exhibits an inside surface, facing the helical spring, against which an end stub of the spring bears;
- each part of the masking piece is formed in one piece with a jaw;
- each part of the masking piece is added to a jaw;
- the masking piece can be designed such that, during the opening of the said clip, each part of the masking piece integral with a jaw becomes hidden under the other jaw. In this case, preferably, each jaw comprises two lugs, pieced with an orifice for the passage of the said spindle, and placed on a same side of the said spring such that the latter is positioned between the two pairs of lugs of the said jaws. For each jaw, on the one hand the lug located furthest towards the outside with respect to the spring can be an integral part of the part of the masking piece associated with the said jaw, and is formed by a lateral protrusion of the latter and, on the other hand, the lug located furthest towards the inside with respect to the spring is formed in one piece with the said jaw and is placed under each part of the masking piece;
- the masking piece can be designed such that, during the opening of the said clip, each part of the masking piece integral with a jaw becomes positioned over the outside surface of the other jaw. In this case, at the junction of the grasping part and the grip of each jaw, a longitudinal slot is provided for the passage of the part of the masking piece associated with the other jaw and, perpendicular to each longitudinal slot, a transverse slot is provided in the grip of each jaw for the passage of the end stub of the said spring bearing against the inside surface of the part of the associated masking piece, during the opening of the said clip. According to this embodiment, each jaw comprises, independently from the masking piece, two lugs for the passage of the said spindle, placed on either side of the said spring: according to a variant, it is possible to provide for each jaw to comprise, independently from the masking piece, two lugs for the passage of the said spindle, placed on a same side of the said spring, such that the latter is positioned between the two pairs of lugs of the said jaws;
- each part of the masking piece exhibits a substantially curved profile enveloping the spring and the articulation spindle; and
- each jaw is formed in one piece by moulding a plastic material.

BRIEF DESCRIPTION OF THE DRAWINGS

The following description, referring to the accompanying drawings given as non-limitative examples, will give a good understanding of what the invention comprises and how it can be embodied.

In the accompanying drawings.

DESCRIPTION OF THE PREFERRED EMBODIMENT

Figure 1:
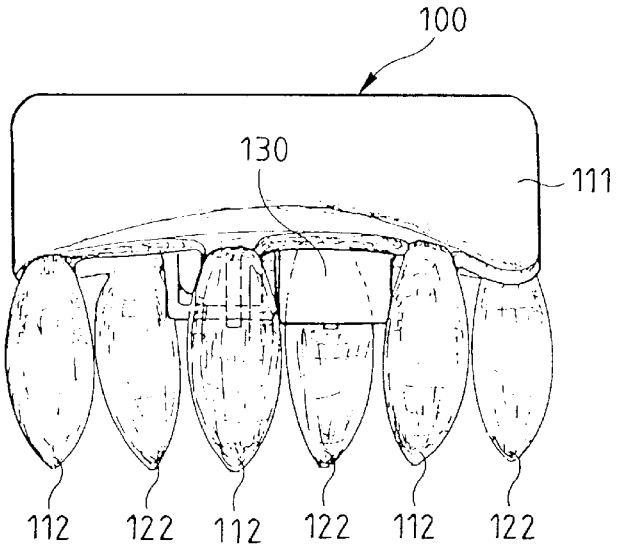
FIG. 1 is a side view of a first embodiment of the hair clip according to the invention.

Firstly, it will be noted that, in all of the embodiments, the identical or similar elements shown in the various figures are, as far as possible, given the same reference signs and are not described each time.

In FIGS. 1 to 5, there has been shown a hair clip 100 which comprises two jaws 110, 120 articulated with respect to each other about a spindle 150 between a closed position (see FIG. 3) and an open position (see FIG. 5) of the clip.

Each of the jaws 110, 120 comprises a grasping part 111, 121 and a grip 112, 122 for attaching the clip to the hair. The grip 122, 112 of each jaw 111, 121, in this case consists of a set of petal-shaped teeth, but these could be of any other shape according to other modes of embodiment which are not shown.

Furthermore, the grasping parts 111, 121 of the jaws 110, 120 in this case have a simplified shape exhibiting a substantially rectangular profile, but according to other modes of embodiment, it would be possible to provide more aesthetic shapes representing, for example, objects, flowers or animals, etc.

Each jaw 110, 120 is in this case made in one piece by moulding a plastic material such as polypropylene, cellulose acetate, polyamide, etc.

The mechanism for the articulation of the jaws 110, 120 with respect to each other, further to the fact that it comprises the articulation spindle 150, comprises a return spring 140 making it possible to return the said jaws 110, 120 to the closed position.

This return spring 140 is a helical spring fitted around the spindle 150.

Furthermore, the hair clip 100 comprises a piece for masking the said spring 140 disposed between the grasping parts 111, 121 of the jaws 110, 120, in such a way as to cover the spring fitted around the spindle 150.

Figure 2:
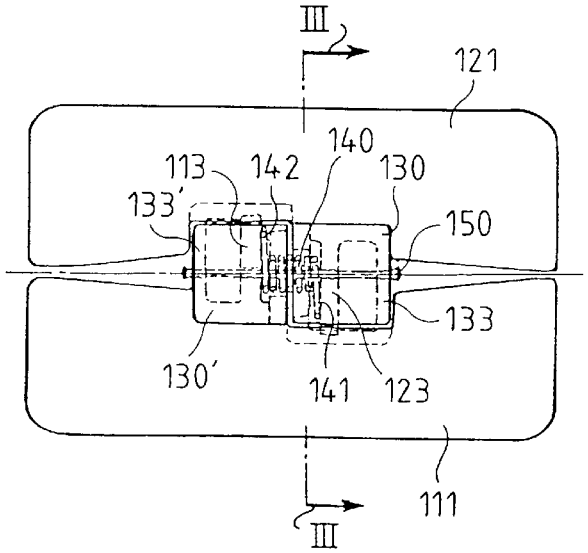
FIG. 2 is a top view of the clip of FIG. 1.

As shown more particularly in FIG. 2, the said masking piece comprises to parts 130', 130 juxtaposed along the direction of the spindle 150, each of the said parts 130', 130 of the masking piece being integral with the grasping part 111, 121 of a jaw 110, 120.

Each of the said parts 130 of the masking piece preferably exhibits a substantially curved profile (see FIGS. 6 and 7 more particularly) enveloping the spring and the articulation spindle, and advantageously comprises an inside surface 131, 132 facing the spring 140, against which bears an end stub 141 of the said spring 140 such that the movement of the end stubs 141, 142 of the said spring 140, during the opening (see FIGS. 5 and 7) and the closing (see FIGS. 3 and 6) of the said clip, takes place inside an internal space below the said masking piece.

The spring 140, including its end stubs 141, 142, is therefore totally concealed under the masking piece and is invisible from the outside.

It will be noted here that the end of each end stub 141, 142 of the spring 140 is stopped against a ledge 132 of the inside surface 131 of each part 130 of the masking piece.

In this case, advantageously, each masking piece 130', 130 is formed by moulding with a jaw 110, 120.

Of course, according to variant which is not shown, it is possible to envisage that each part of the masking piece is added to a jaw by any system whatsoever, such as gluing for example.

Figure 3:
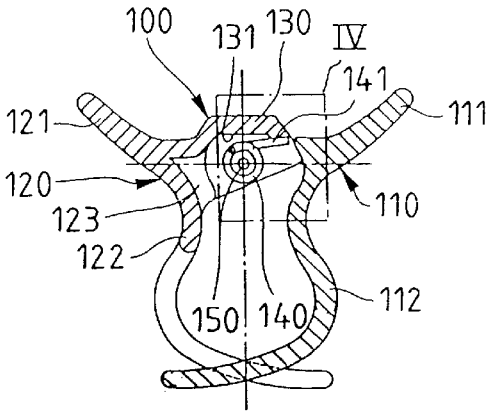
FIG. 3 is a cross-sectional view along the plane II—II of FIG. 3.
Figure 4:
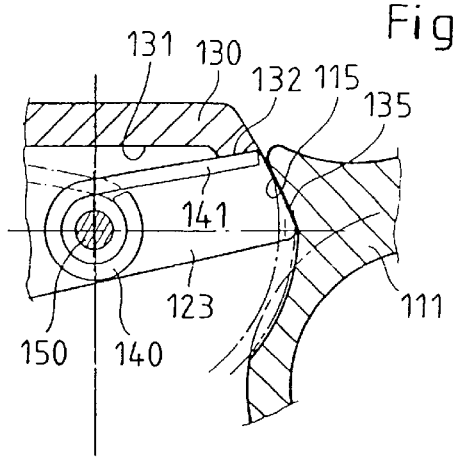
FIG. 4 is a detail view of zone IV FIG. 3.
Figure 5:
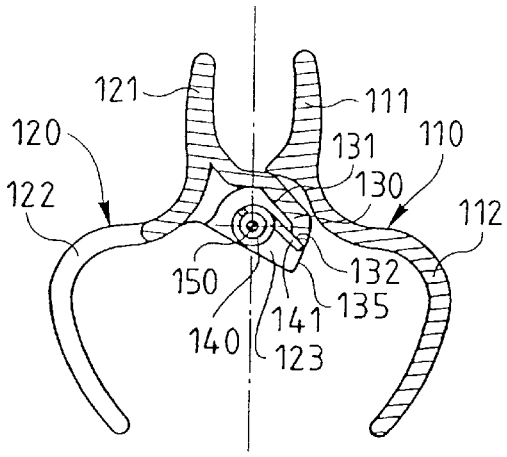
FIG. 5 is a transverse cross-section of the clip, in the open position.

According to the embodiment shown in FIGS. 1 to 5, and as shown more particularly in FIGS. 3 to 5, the masking piece is designed such that during the opening of the said clip, each part 130 of the said masking piece integral with a jaw 120 becomes hidden under the other jaw 110. The inside shape of each jaw, and more particularly of the junction between the grasping part and the grip of each jaw is therefore designed in order to allow the positioning of each part of the masking piece facing an internal face of each jaw during the opening of the said clip, as is shown more particularly in FIG. 5.

In the closed position, shown in FIG. 3, each part 130 of the masking piece integral with a jaw 120, comprises on one edge a flat 135 which is positioned against a complementary flat surface 115 of the jaw 110 situated facing it, this complementary flat surface being situated at the junction between the grasping part and the grip of the said corresponding jaw (see FIG. 4 more particularly).

According to this embodiment, each jaw 110, 120 comprises two lugs 113, 133', 123, 133 pierced with an orifice for the passage of the spindle 150, and placed on a same side of the spring 140 such that the latter is positioned between the two pairs of lugs of the said jaws.

For each jaw 110, 120, the lug 133', 133 located furthest towards the outside with respect to the spring 140 forms an integral part of the part 130', 130 of the masking piece associated with the said jaw 110, 120, and is formed by a lateral protrusion of the latter.

Furthermore, for each jaw 110, 120, the lug 113, 123 located furthest towards the inside with respect to the spring 140 is formed in one piece with the said jaw.

Advantageously, the lugs 113, 133', 123, 133 of the jaws 110, 120 are entirely concealed by the masking piece.

In this case, the assembly of the lugs, of one part of the masking piece, of the grasping part and of the grip form a single piece produced by moulding a plastic material.

Figure 6:
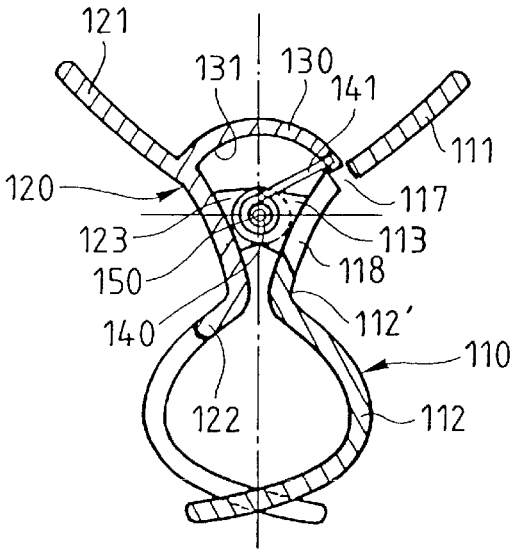
FIGS. 6 and 7 are cross-sectional views identical to those of FIGS. 3 and 5 of a second embodiment of the hair clip according to the invention, in the closed and open positions.
Figure 7:
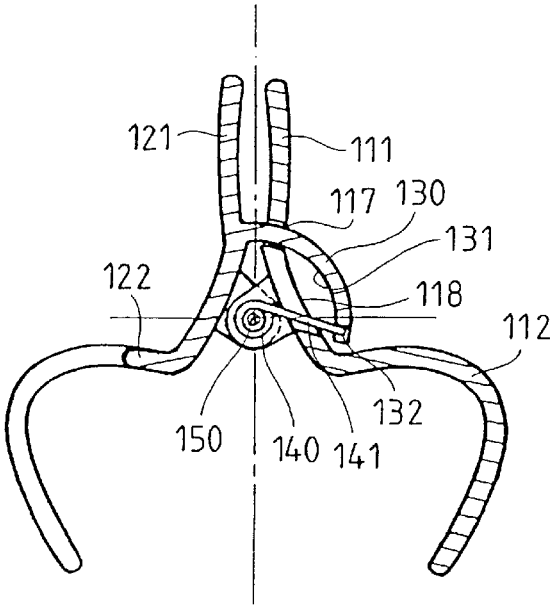

According to a variant shown more particularly in FIGS. 6 and 7, the masking piece is designed such that during the opening of the clip, each part 130 of the masking piece integral with a jaw 120, becomes positioned against, or facing, the outside surface 112' of the other jaw 110.

In this case, a longitudinal slot 117 is provided at the junction of the grasping part 111 and the grip 112 of each jaw 110 for the passage of the said part 130 of the masking piece associated with the other jaw 120, during the opening of the clip.

Furthermore, perpendicular to each longitudinal slot 117, a transverse slot 118 is provided in the grip 112 of each jaw 110 for the passage of the end stub 141 of the spring 140 bearing against the inside surface 131, 132 of the part 130 of the associated masking piece, during the opening of the clip.

According to the embodiment shown in FIGS. 6 and 7, each jaw 110, 120 comprises, independently from the masking piece, two lugs 113, 123 for the passage of the said spindle, placed on either side of the said spring, as is provided conventionally.

According to a variant which is not shown, it is possible to envisage that the two lugs of a jaw are positioned on the same side of the spring as is provided according to the embodiment shown in FIGS. 3 and 5.

Here also, the lugs, the part of the masking piece associated with the said jaw, the grasping part and the grip of each jaw form a single piece produced by moulding a plastic material.

The hair clip can be assembled manually or by any appropriate automatic assembly device.

The present invention is in no way limited to the embodiments described and shown and those skilled in the art will know how to apply to it any variant complying with its principle.

What is claimed is:

1. Hair clip (110) comprising:

two jaws (100, 120), each of them having a grasping part (111, 121) and articulated with respect to the other about a spindle (150) between a closed position and an open position of the clip, and returned to the closed position by a helical spring (140) fitted around said spindle (150) said spindle (150) having a longitudinal axis, and a piece for masking said spring, disposed between the two grasping parts in such a way as to cover the part of said spring fitted around said spindle, wherein, said masking piece comprises two separate parts (130', 130) juxtaposed along the longitudinal axis of said spindle (150), such that each part rotates in a direction opposite to the other part about the longitudinal axis of said spindle (150) each of said parts (130', 130) of the masking piece being integral with the grasping part (111, 121) of one jaw (110, 120), said spring (140) having end stubs bearing against a corresponding part of said masking piece such that the place of motion of said end stubs (141, 142) of said spring, during the opening and closing of said clip, is situated under said masking piece.

2. Hair clip according to claim 1, characterised in that each part (130', 130) of the masking piece exhibits an inside surface (131, 132), facing the helical spring, against which an end stub (141, 142) of the said spring (140) bears.

3. Hair clip according to claim 1, characterised in that each part (130', 130) of the masking piece is formed in one piece with a jaw.

4. Hair clip according to claim 1, characterised in that each part of the masking piece is added to a jaw.

5. Hair clip according to claim 1, characterised in that the masking piece is designed such that, during the opening of said clip, each part (130', 130) of the masking piece integral with a jaw (110, 120) becomes hidden under the other jaw (120, 110).

6. Hair clip according to claim 5, characterised in that each jaw (110, 120) comprises two lugs (114, 113'; 123, 133), pierced with an orifice for the passage of said spindle, and placed on a same side of said spring (140) such that the latter is positioned between the two pairs of lugs of said jaws.

7. Hair clip according to claim 6, characterised in that for each jaw, the lug (133', 133) located furthest towards the outside with respect to the spring (140) is an integral part of the part (130', 130) of the masking piece associated with said jaw (110, 120), and is formed by a lateral protrusion of the latter.

8. Hair clip according to claim 6, characterised in that for each jaw, the lug (113, 123) located furthest towards the inside with respect to the spring (140) is formed in one piece with said jaw (110, 120) and is placed under each part of the masking piece.

9. Hair clip according to claim 1, characterised in that the masking piece is designed such that, during the opening of said clip, each part (130) of the masking piece integral with a jaw (120) becomes positioned over the outside surface (112') of the other jaw (110).

10. Hair clip according to claim 9, characterised in that, at the junction of the grasping part (111) and the grip (112) of each jaw (110), a longitudinal slot (117) is provided for the passage of the part (130) of the masking piece associated with the other jaw (120), during the opening of said clip.

11. Hair clip according to claim 10, characterised in that, perpendicular to each longitudinal slot (117), a transverse slot (118) is provided in the grip (112) of each jaw (110) for the passage of one end stub (141) of the said spring (140) bearing against the inside surface (131, 132) of the part (130) of the associated masking piece, during the opening of said clip.

12. Hair clip according to claim 9, characterised in that each jaw (110, 120) comprises, independently from the masking piece two lungs (113, 123) for the passage of said spindle, placed on either side of said spring.

13. Hair clip according to claim 9, characterised in that each jaw comprises, independently from the masking piece, two lugs for the passage of said spindle, placed on a same side of said spring, such that the latter is positioned between the two pairs of lugs of said jaws.

14. Hair clip according to claim 1, characterised in that each part (130) of the masking piece exhibits a substantially curved profile enveloping the spring and the articulation spindle.

15. Hair clip according to claim 1, characterised in that each jaw (110, 120) is formed in one piece by moulding a plastic material.

16. Hair clip comprising:

two jaws, each having a grasping part and articulated with respect to the other about a spindle between a closed position and an open position of the clip;

the two jaws being returned to the closed position by a helical spring fitted around said spindle, said spindle having a longitudinal axis; and a piece for masking said spring, disposed between the two grasping parts in such a way as to cover the part of said spring fitted around said spindle, wherein, said masking piece comprises two separate parts juxtaposed along the direction longitudinal axis of said spindle, such that each part rotates in a direction opposite to the other part about the longitudinal axis of said spindle, each of said parts of the masking piece being formed in one piece with a jaw and being integral with the grasping part of one jaw, said spring having end stubs bearing against a corresponding part of said masking piece such that the place of motion of said end stubs of said spring, during the opening and closing of said clip, is situated under said masking piece.

17. Hair clip comprising;

two jaws, each of them having a grasping part and articulated with respect to the other about a spindle between a closed position and a open position of the clip;

the two jaws being returned to the closed position by a helical spring fitted around said spindle, said spindle having a longitudinal axis; and a piece for masking said spring, disposed between the two grasping parts in such a way as to cover the part of said spring fitted around said spindle, wherein;

said masking piece comprises two separate parts juxtaposed along the longitudinal axis of said spindle, such that each part rotates in a direction opposite to the other part about the longitudinal axis of said spindle each of said parts of the masking piece being integral with the grasping part of one jaw, each part of the masking piece extending from a grasping part, generally transversally to said grasping part, in direction to the other grasping part, and presenting an integral surface forming a recess facing the spring, end stubs of said spring bearing against a bottom of said recess such that the place of motion of said end stubs of said spring, during the opening and closing of said clip, is situated under said masking piece.

* * * * *